US007086355B2

(12) United States Patent
Yamamoto

(10) Patent No.: US 7,086,355 B2
(45) Date of Patent: Aug. 8, 2006

(54) CYLINDER HEAD STRUCTURE OF ENGINE

(75) Inventor: Akimasa Yamamoto, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 20 days.

(21) Appl. No.: 10/891,079

(22) Filed: Jul. 15, 2004

(65) Prior Publication Data

US 2005/0039706 A1 Feb. 24, 2005

(30) Foreign Application Priority Data

Jul. 16, 2003 (JP) ..... 2003-197843

(51) Int. Cl.
*F01P 3/00* (2006.01)

(52) U.S. Cl. ..... 123/41.72; 123/41.74

(58) Field of Classification Search ..... 123/41.72, 123/41.82 R, 41.79, 41.74
See application file for complete search history.

(56) References Cited

U.S. PATENT DOCUMENTS 4,590,894 A * 5/1986 Ishida et al. ..... 123/41.74
4,759,317 A * 7/1988 Ampferer ..... 123/41.74
5,094,193 A * 3/1992 Yoshikawa ..... 123/41.82 R
5,152,255 A * 10/1992 Fukuda ..... 123/41.33
5,529,027 A * 6/1996 Okubo ..... 123/41.01
5,699,760 A * 12/1997 Yang et al. ..... 123/41.74
5,769,038 A * 6/1998 Takahashi et al. .... 123/41.82 R
5,836,272 A * 11/1998 Sakurai ..... 123/41.82 R
5,868,106 A * 2/1999 Poropatic et al. ..... 123/41.82 R
6,202,603 B1 * 3/2001 Etemad ..... 123/41.74
6,481,392 B1 * 11/2002 Etemad ..... 123/41.74
6,530,356 B1 * 3/2003 Inoue et al. ..... 123/196 R

FOREIGN PATENT DOCUMENTS

JP 4-44816 Y2 10/1992

* cited by examiner

*Primary Examiner*—Noah P. Kamen
*Assistant Examiner*—Jason Benton
(74) *Attorney, Agent, or Firm*—Birch, Stewart, Kolasch & Birch, LLP

(57) ABSTRACT

Head cooling passages are formed around intake ports and exhaust ports provided in a cylinder head, and a flow control member which controls the volume of cooling medium flowing toward the intake ports to be larger than the volume of cooling medium flowing toward the exhaust ports is provided in the vicinity of a supply port via which cooing medium is supplied.

9 Claims, 3 Drawing Sheets

CYLINDER HEAD STRUCTURE OF ENGINE

CROSS-REFERENCE TO RELATED APPLICATION

This application incorporates by reference the subject matter of Application No. 2003-197843 filed in Japan on Jul. 16, 2003, on which a priority claim is based under 35 U.S.C. § 119(a).

BACKGROUND OF THE INVENTION

1. Field of the Invention

The present invention relates to a cylinder head structure of an engine in which a cooling medium is supplied to a cylinder head.

2. Description of the Related Art

An engine of the type that cooling water discharged from a cooling pump is supplied to a cylinder head before it is supplied to a cylinder block to efficiently cool the cylinder head has been disclosed in Japanese Utility Model Examined Publication No. 4-44816 (refer to the fourth line in the fifth row in the right column of the third page to the third line in the ninth row of the right column of the fifth page, and FIGS. 1 to 6). In such an engine, cooling water is supplied from a cooling water inlet provided at an end of the cylinder head to a cooling water passage in the cylinder head by the cooling water pump. The cooling water which has flown through the cooling water passage in the cylinder head is caused to pass through the cylinder block via a cooling water outlet passage on the cylinder head side, and pass through a cooling water passage in the cylinder block, and is then retuned to a radiator.

To cool the cylinder head to improve an octane value, and on the other hand, to prevent the viscosity of lubricant flowing in the cylinder block from being excessively increased due to excessive cooling of the cylinder block, a cooling water flow control valve controls the volume of cooling water flowing through the cooling water passage in the cylinder block so that the temperature of the cylinder block can be kept at an appropriate temperature.

The cooling water supplied via one end of the cylinder head swiftly flows in the direction in which cylinders are arranged, and is divided into a flow toward intake ports and a flow toward exhaust ports by spark plug mounting parts disposed at the centers of the respective cylinders. In the cylinder head, however, the temperature of the spark plug mounting parts and the temperature of the exhaust ports are high, and hence the cooling water heats up while flowing along the spark plug mounting parts, and the intake ports and the exhaust ports cannot be efficiently cooled.

The temperature of the intake ports affects the density of gas supplied into the cylinders. Specifically, if the intake ports cannot be sufficiently cooled, the density of gas supplied into cylinders lowers and decreases engine output.

SUMMARY OF THE INVENTION

The present invention provides a cylinder head structure of an engine, which makes it possible to efficiently cool intake ports.

More specifically, the present invention provides an engine which comprises head cooling passages formed around intake ports and exhaust ports provided in a cylinder head; a supply port that supplies a cooling medium into the head cooling passages; and a flow control member provided in the vicinity of the supply port, for controlling the volume of cooling medium flowing in the head cooling passages such that the volume of cooling medium flowing toward the intake ports is larger than the volume of cooling medium flowing toward the exhaust ports.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PRESENT INVENTION

Figure 1:
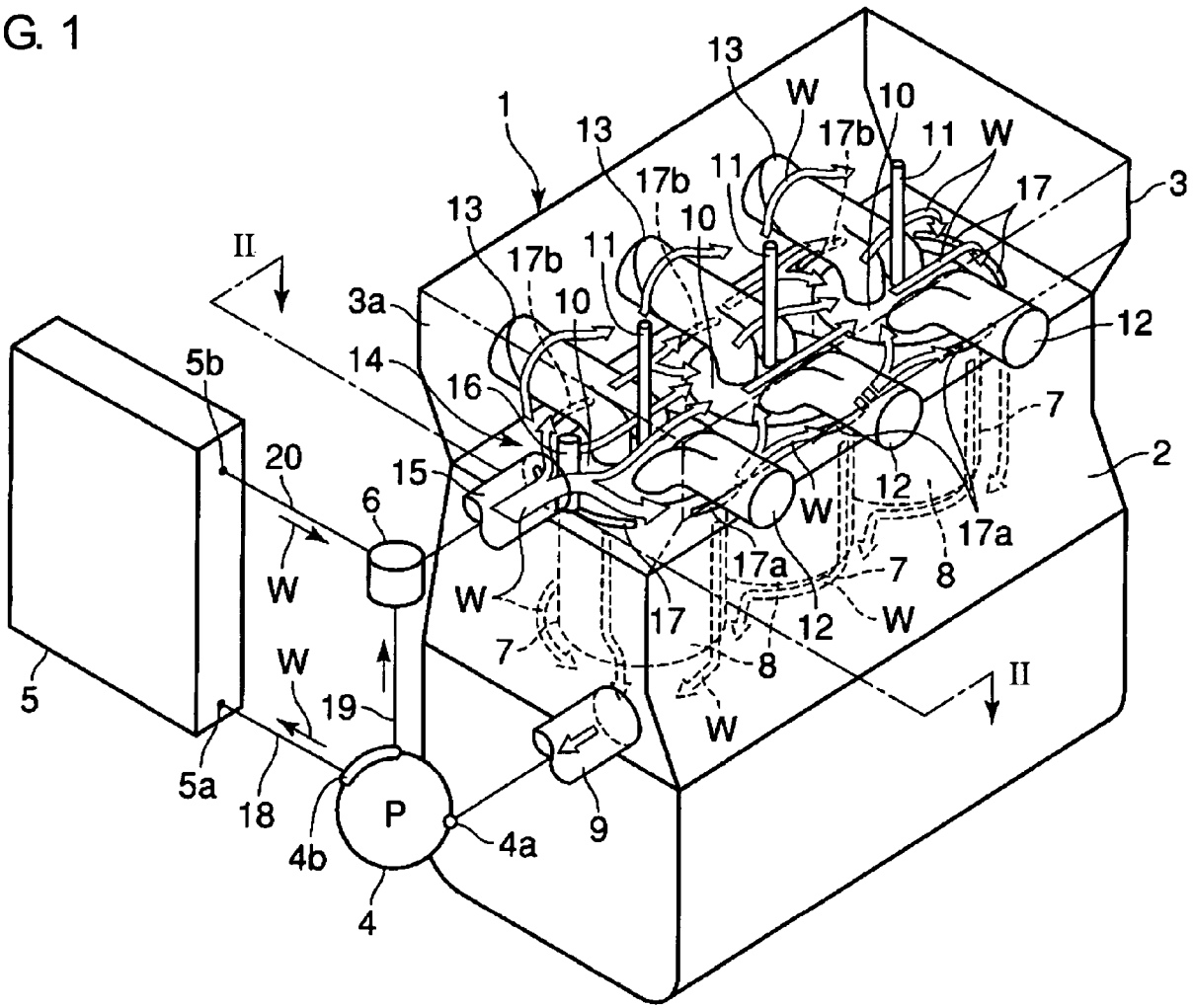
FIG. 1 is a perspective view showing the flow of cooling water in a cylinder head of an engine according to an embodiment of the present invention.

A description will now be given of an engine 1 according to an embodiment of the present invention with reference to FIGS. 1 to 3. The engine 1 in FIG. 1 is comprised of a cylinder block 2, a cylinder head 3, a water pump 4, a radiator 5, and a thermostat 6. In the cylinder block 2, water jackets 8, as block cooling passages, are disposed along the outer circumferences of cylindrical surfaces of cylinders 7. In FIG. 1, arrows indicate flow of cooling water. The cylinder block 2 is provided with an outlet 9 located away from the cylinder head 3 and in communication with the water jackets 8.

The cylinder head 3 is provided with combustion chambers 10, spark plug mounting parts 1, intake ports 12, exhaust ports 13, and head cooling passages 14. The spark plug mounting parts 1 are located such that spark plugs are closer to the exhaust ports 13 relative to the axes of the cylinders 7. The intake ports 12 are opened in such a direction as to cross the central axes of the cylinders 7 and along the direction in which the cylinders 7 are arranged. The exhaust ports 13 are formed symmetrically with respect to the intake ports 12 across the axes of the cylinders 17. The intake ports 12 and the exhaust ports 13 are two-forked in communication with the combustion chambers 10. The head cooling passages 14 are formed around the intake ports 12, the exhaust ports 13, and the spark plug mounting parts 1. In the direction in which the cylinders 7 are arranged, a supply port 15, in communication with the head cooling passages 14, is opened at an end 3*a* of the cylinder head 3.

Figure 2:
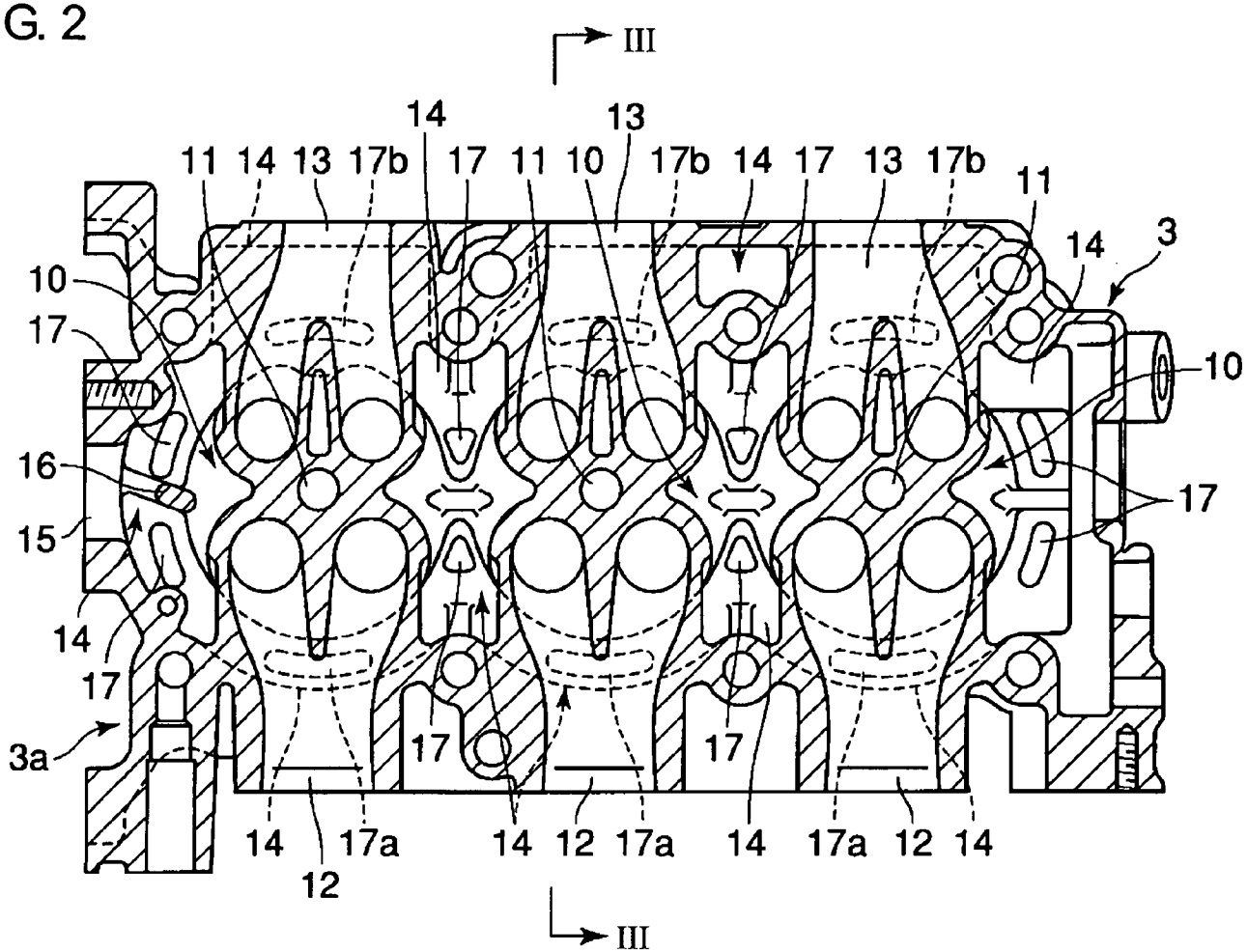
FIG. 2 is a sectional view of the cylinder head along the line II—II of FIG. 1.

As shown in FIG. 2, a flow control member 16 is provided in the head cooling water passages 14 and in the vicinity of the supply port 15. The flow control member 16 is disposed in a direction from the lower surface to the upper surface of the cylinder head 3 such that the flow W of cooling water can be divided into a flow toward the intake ports 12 and a flow toward the exhaust ports 13. The flow control member 16 has such a sectional shape that the downstream side thereof in the direction of the flow W of cooling water is deviated toward the intake ports 12. Downstream of the flow control member 16, the head cooling passages 14 on the intake port 12 side and the head cooling passage 14 on the exhaust port 13 side are in communication with each other to prevent shortage of cooling water on the exhaust port 13 side.

Figure 3:
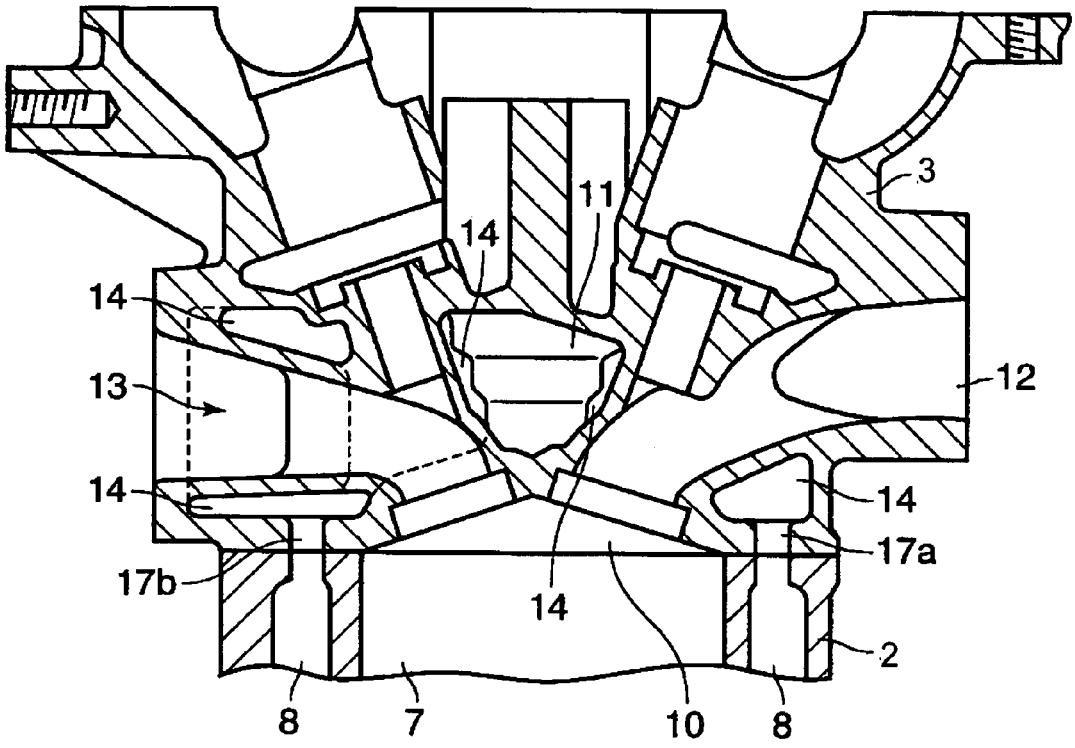
FIG. 3 is a sectional view of the cylinder head along the line III—III of FIG. 1.

Further, as shown in FIG. 3, the head cooling passages 14 are formed with discharge holes 17*a*, 17*b* in communication with the water jackets 8 of the cylinder block 2 at a plurality of locations within a range corresponding to the water jackets 8. Specifically, as shown in FIG. 2, in the head cooling passage 14, the discharge holes 17 in communication with the water jackets 8, are formed between the intake ports 12 and the cylinder block 2 at the intake port 12 side of the flow control member 16 and between the exhaust ports 13 and the cylinder block 2 at the exhaust ports 13 side of the flow control member 16, the intake port 12 side and the exhaust ports 13 side of the flow control member 16, between the adjacent cylinders 7, and at a location furthest away from the supply port 15.

In this case, the flow passage area of intake side discharge holes 17*a* formed between the intake ports 12 and the cylinder block 2 is larger than the flow passage area of exhaust side discharge holes 17*b* formed between the exhaust ports 13 and the cylinder block 2. By positively increasing the volume of cooling water flowing toward the intake ports 12, it is possible to cool the intake ports 12 in a more efficient manner. Also, the intake side discharge holes 17*a* and the exhaust side discharge holes 17*b* are configured to have a larger flow passage area as they become further away from the supply port 15. Thus, the volume of cooling water flowing from the intake side discharge holes 17*a* and the exhaust side discharge holes 17*b* located further away from the supply port 15 is larger than the volume of cooling water flowing from the intake side discharge holes 17*a* and the exhaust side discharge holes 17*b* located closer to the supply port 15. This reduces the possibility that cooling water is discharged from the intake side discharge holes 17*a* and the exhaust side discharge holes 17*b*, which are closer to the supply port 15, to the water jackets 8 to deteriorate the efficiency of cooling the intake ports 12 and the exhaust ports 13 located further away from the supply port 15. Also, the flow W of cooling water flowing around the intake ports 12 and the exhaust ports 13 can satisfactorily spread to an area away from the supply port 15. It is preferred that the flow passage area ratio of the intake side discharge holes 17*a* and the exhaust side discharge holes 17*b* closer to the supply port 15 to the intake side discharge holes 17*a* and the exhaust side discharge holes 17*b* further away from the supply port 15 is determined such that the amount of heat absorbed from the intake ports 12 is equal to the amount of heat absorbed from the exhaust ports 13. It should be noted that the efficiency of cooling the cylinder head 3 can be improved since cooling water is supplied to the cylinder head 3 before it is supplied to the cylinder block 2.

An inlet port 4*a* of the water pump 4 is connected to the discharge port 9 for the water jackets 8 in the cylinder block 2. An outlet port 4*b* of the water pump 4 is connected to an inlet 5*a* of the radiator 5 via an inlet passage 18, and is in communication with the supply port 15 of the cylinder head 3 through a bypass passage 19 via the thermostat 6. Also, an outlet 5*b* of the radiator 5 is in communication with the supply port 15 of the cylinder head 3 through an outlet passage 20 via the thermostat 6.

When the temperature of the cooling water flowing from the water pump 4 becomes equal to or higher than a predetermined temperature, the thermostat 6 shuts off the bypass passage 19 which brings the water pump 14 and the supply port 15 into communication with each other, and opens the outlet passage 20 which brings the radiator 5 and the supply port 15 into communication with each other. Conversely, when the temperature of the cooling water flowing from the water pump 4 becomes equal to or lower than a predetermined temperature, the thermostat 6 shuts off the outlet passage 20 which brings the radiator 5 and the supply port 15 into communication with each other, and opens the bypass passage 19 which brings the water pump 14 and the supply port 15 into communication with each other.

In the engine 1 constructed as described above, the flow control member 16 divides the cooling water flowing from the supply port 15 into the head cooling passage 14 such that the volume of cooling water toward the intake ports 12 is larger than the volume of cooling water flowing toward the exhaust ports 13, as shown by arrows in FIG. 1. The cooling water toward the intake ports 12 flows mainly into the head cooing passage 14 formed between the intake ports 12 and the cylinder block 2 as shown in FIG. 3. On the other hand, the cooling water toward the exhaust ports 13 mainly flows into the head cooling passage 14 formed between the exhaust ports 13 and the cylinder block 2 and along outer surfaces of the exhaust ports 13 which are opposite to the cylinder block 2 as shown in FIG. 3. Part of the cooing water divided by the flow control member 16 joins together again downstream of the flow control member 16, and flows into the head cooling passages 14 formed around the spark plug mounting parts 1 as shown in FIG. 3.

The cooling water flowing through the head cooling passages 14 flows into the water jackets 8 through the discharge holes 17 opened from the head cooling passages 14 toward the cylinder block 2. The cooling water is sent from the water jackets 8 to the water pump 4 via the discharge port 9. If the cooling water temperature is equal to or lower than a set temperature, the thermostat 6 shuts off the outlet passage 20, and hence the cooling water discharged from the water pump 4 flows from the supply port 15 into the head cooling water 14 through the bypass passage 19. If the cooling water temperature becomes equal to or higher than the set temperature, the thermostat 6 shuts off the bypass passage 19, and hence the cooling water discharged from the water pump 4 is sent to the radiator 5 and is radiated heat, and then flows from the supply port 15 into the head cooling passage 14 through the outlet passage 20.

In the engine 1 constructed as described above, the flow control member 16 causes a larger volume of cooling water to flow on the intake port 12 side than on the intake port 13 side in the head cooling passages 14. Therefore, the intake ports 12 can be positively cooled, and the gas can be taken from the intake ports 12 into the cylinders 7 and the combustion chambers 10 at a high density. Namely, it is possible to prevent the compression ratio of gas from being lowered. This prevents a decrease in the output of the engine 1.

Further, among the discharge holes 17 provided in the head cooling passage 14 and in communication with the water jackets 8, the intake side discharge holes 17*a* provided between the intake ports 12 and the cylinder head 3 have a larger flow passage area as compared with the exhaust side discharge holes 17*b* formed between the intake ports 13 and the cylinder head 3. Therefore, a larger volume of cooling water flows into the water jackets 8 from the exhaust side discharge holes 17*b* than from the intake side discharge holes 17*a*. Namely, a larger volume of cooling water flows on the intake port 12 side. As a result, the intake ports 12 can be cooled positively and efficiently. Further, the intake side discharge holes 17*a* and the exhaust side discharge holes 17*b* located further away from the supply port 15 via which cooling water flows into the head cooling passage 14 have a larger flow passage area as compared with the intake side discharge holes 17*a* and the exhaust side discharge holes 17*b* located closer to the supply port 15. This increases the volume of cooling water flowing around the intake ports 12 and the exhaust ports 13 further away from the supply port 15, and reduces a difference in cooling efficiency between the intake ports 12 and the exhaust ports 13 closer to the supply port 15 and the intake ports 12 and the exhaust ports 13 further away from the supply port 15. This reduces a difference in compression ratio among the cylinders 7, and decreases variations in the output of the engine 1.

It should be noted that the flow control member 16 may be cast integrally with the cylinder block 2, or may be installed as a separate body. Also, the flow control member 16 should be configured such that a larger volume of cooling water flows in the head cooling passages at the intake port 12 side than at the exhaust port 13 side, and therefore, rather than providing only one flow control member 16, a plurality of flow control members 16 may be provided to guide cooling water toward the intake ports 12. Further, the flow control member 16 may not necessarily be vane-shaped with such a section as to extend in the direction in which cooling water flows, but may be porous or meshed with a larger opening on the intake port 12 side such that a larger volume of cooling water can flow on the intake port 12 side.

Further, cooling water is only an example of cooling medium, and may also be oil, gas, or the like insofar as it has enough heat capacity to cool the cylinder head 3 and the cylinder block 2.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims:

I claim:

1. An engine, comprising:

head cooling passages formed around intake ports and exhaust ports provided in a cylinder head;

a supply port, formed in the cylinder head, that supplies a cooling medium directly into said head cooling passages; and a flow control member provided in vicinity of said supply port, for controlling a volume of cooling medium flowing in said head cooling passages such that a volume of cooing medium flowing the intake ports is larger than a volume of cooling medium flowing toward the exhaust ports.

2. An engine according to claim 1, wherein said flow control member is provided to divide a flow of cooling medium into a flow toward the intake ports and a flow toward the exhaust ports, and is formed in a manner being extended from an upstream side toward a downstream side in a flowing direction of the cooling medium, such that the downstream side being closer to the intake ports than the upstream side.

3. An engine according to claim 2, wherein said head cooling passages on the intake port side and the exhaust port side are in communication with each other downstream of the flow control member in the flowing direction.

4. An engine according to claim 1, wherein said supply port of said head cooling passages is provided at an end of a cylinder bank.

5. An engine according to claim 1, wherein the cooling medium is supplied from said head cooling passages, and then flows into a block cooling passage provided in the cylinder block.

6. An engine according to claim 1, wherein said head cooling passages include intake side discharge holes formed on side of the intake ports, for discharging the cooling medium into the block cooling passage, and exhaust side discharge holes formed on side of the exhaust ports, for discharging the cooling medium into the block cooling passage, said intake side discharge holes having a larger flow passage area as compared with said exhaust side discharge holes.

7. An engine according to claim 6, wherein said intake side discharge holes and said exhaust side discharge holes are formed to have a larger flow passage area as said intake side discharge holes and said exhaust side discharge holes become further away from said supply port of said head cooling passages.

8. An engine according to claim 1, wherein said flow control member includes a plate member provided in a manner being extended in a direction in which the cooling medium flows.

9. An engine according to claim 1, wherein said flow control member is formed to cross said head cooling passage in a direction from a lower surface to an upper surface of the cylinder head.

* * * * *